US005080578A

United States Patent [19]

Josephs et al.

[11] Patent Number: 5,080,578

[45] Date of Patent: Jan. 14, 1992

[54] LIQUID FUEL BURNING HEATER HAVING FLAME STOPPING MEANS

[76] Inventors: Harold Josephs, 25311 Ronald Crt., Oak Park, Mich. 48237; Levon H. Keshishian, 21932 Riverview Dr., Birmingham, Mich. 48010

[21] Appl. No.: 654,282

[22] Filed: Feb. 12, 1991

[51] Int. Cl.[5] ..... F23N 5/00

[52] U.S. Cl. ..... 431/33; 431/22; 431/77; 236/1 H

[58] Field of Search ..... 431/22, 33, 77; 236/1 H, 96

[56] References Cited

U.S. PATENT DOCUMENTS

| | | | |
|---|---|---|---|
| 2,348,709 | 5/1944 | Breese | 236/1 H |
| 4,052,136 | 10/1977 | Ulricksen | 431/77 |
| 4,797,088 | 1/1989 | Hakamura et al. | 431/33 |

*Primary Examiner*—Carroll B. Dority

*Attorney, Agent, or Firm*—Harness, Dickey & Pierce

[57] ABSTRACT

An apparatus for extinguishing undesired flames in liquid fuel-burning heaters having a wick partially disposed in a fuel supply reservoir in fluid communication with a fuel tank said apparatus comprising fuel flow cut-off means for interrupting said fluid communication in response to sensing excessive heat and wick withdrawal means for retracting said wick entirely into said wick fuel supply reservoir in response to sensing of excessive heat.

6 Claims, 3 Drawing Sheets

LIQUID FUEL BURNING HEATER HAVING FLAME STOPPING MEANS

BACKGROUND AND SUMMARY OF THE INVENTION

This invention relates to wick fed liquid fuel-burning systems such as kerosene heaters. More particularly this invention relates to an apparatus for limiting the spread of excessive flames by extinguishing the flame of a wick fed liquid fuel-burning apparatus in response to sensing excessive heat. The apparatus extinguishes the flame by retracting the wick which smothers the flame and shutting off the flow of liquid fuel from the fuel tank which precludes additional fuel from reaching the flames.

In wick fed liquid fuel-burning heaters the flame is provided liquid fuel for combustion by a wick which is exposed to the oxygen of the atmosphere. Once the wick has been ignited, flame intensity and heat generation are controlled by positioning the wick with respect to a wick receiving chamber. The greater the amount of wick that is exposed, the greater is the flame intensity and heat.

One foreseeable hazard in using wick fed liquid fuel-burning heaters is the possibility of a fire resulting from excessive flames due to a flare-up. Flare-ups occur for a number of reasons, including using an inappropriate fuel, such as gasoline in a kerosene heater; using contaminated fuel or when a freestanding heater is tipped over and fuel escapes out of the wick supply reservoir. Once fuel escapes outside of the wick supply reservoir, due to "over-wicking" by using a more volatile fuel than kerosene, or due to tip over spills or due to other reasons, the possibility of a fire drastically increases.

The prior art includes "tip over" safety devices and several patents reflect efforts to incorporate certain safety features in fuel burning heaters. Examples include U.S. Pat. Nos. 4,424,019 issued Jan. 3, 1984 to Nakamura and 4,562,825 issued Jan. 7, 1986 to Nishikawa. However, these examples of liquid fuel-burning heaters are not provided with heat sensing devices to cause the flow of fuel to be blocked or the wick to be withdrawn.

Accordingly, an object of the present invention is to limit the spread of excessive flames in liquid fuel-burning heaters regardless of the cause of the excessive flames. In accordance with the present invention, means are provided for cutting off the flow of fuel to the wick supply reservoir in response to excessive heat. In the presence of excessive heat generated by unwanted flames a sensor device blocks fuel flow through a valve located between the fuel tank and the wick supply reservoir thereby shutting off the flow of fuel to the wick supply reservoir. Additionally, the present invention provides means for automatically withdrawing the wick into the wick chamber when sensing excessive heat. Thus, excessive heat activates a heat sensor which operates a lever attached to a spring loaded ratchet control gear. The lever disengages the control gear causing it to rotate. As the ratchet control gear rotates, the wick is withdrawn into the wick chamber. Once the wick is sufficiently contained within the wick chamber, it ceases to provide fuel for further combustion outside the chamber and combustion within the wick chamber cannot occur because the oxygen necessary to sustain such combustion is not available.

DESCRIPTION OF THE PREFERRED EMBODIMENTS

Figure 1:
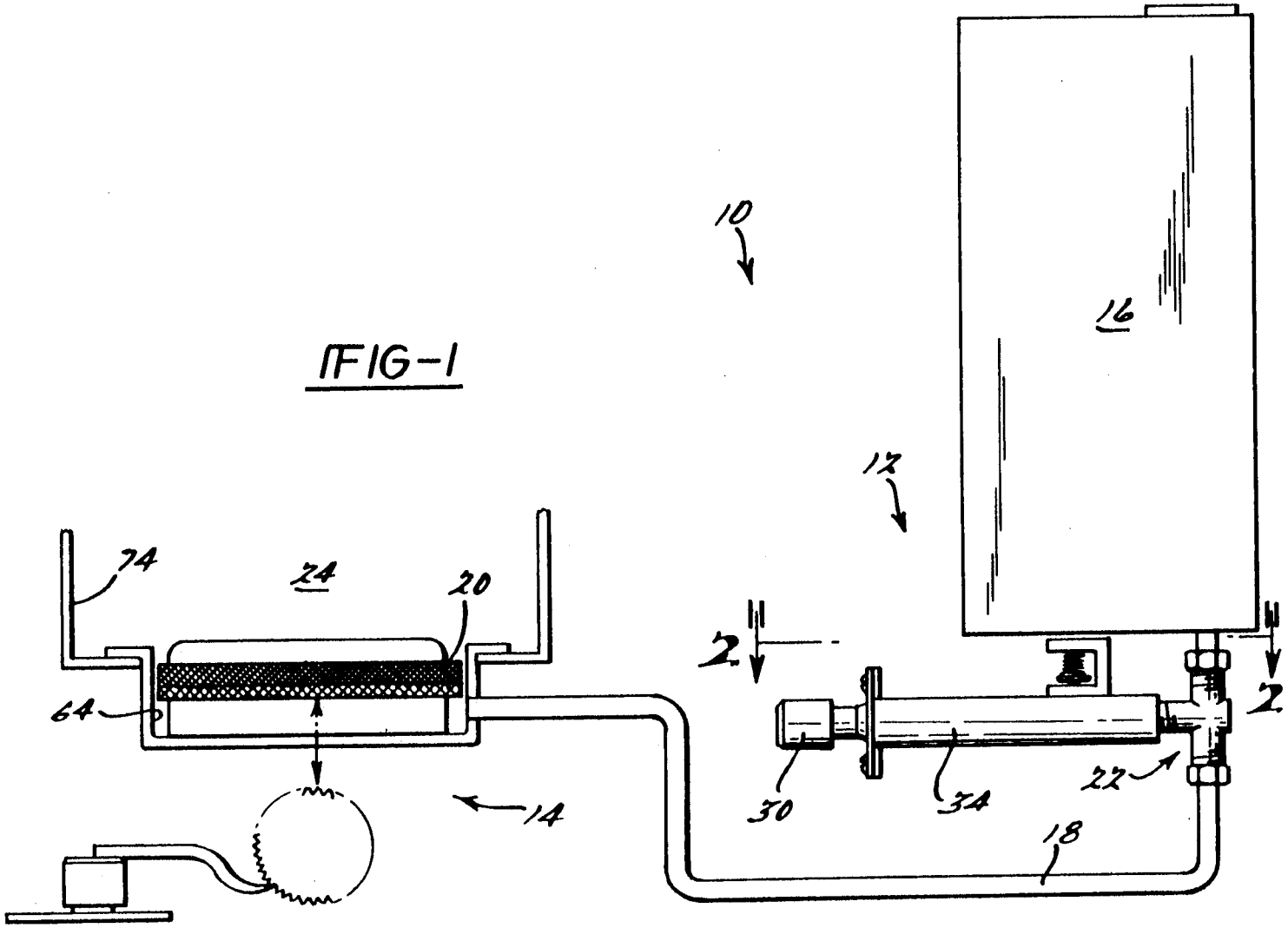
FIG. 1 is a side elevational view of the operating mechanism of a preferred embodiment of the present invention.

Referring now to a preferred embodiment of the drawings, the present invention is shown in FIG. 1 and indicated generally by the numeral 10. Heater 10 is a liquid fuel burning heater having a flame control feature comprising both fuel flow cut-off means 12 and wick withdrawal means 14. In normal operation of heater 10, fuel tank 16 delivers fuel through fuel line 18 to wick 20. Fuel line 18 thus provides fluid communication between tank 16 and wick 20 through valve 22.

If excessive heat occurs in, around or about chamber 24, the flame control means of the present invention operates. The flame control means comprises fuel flow cut-off means 12 for interrupting flow of fuel to wick 20 and wick withdrawal means 14 for withdrawing wick 20 into a retracted position where oxygen to support combustion is not available.

Figure 2:
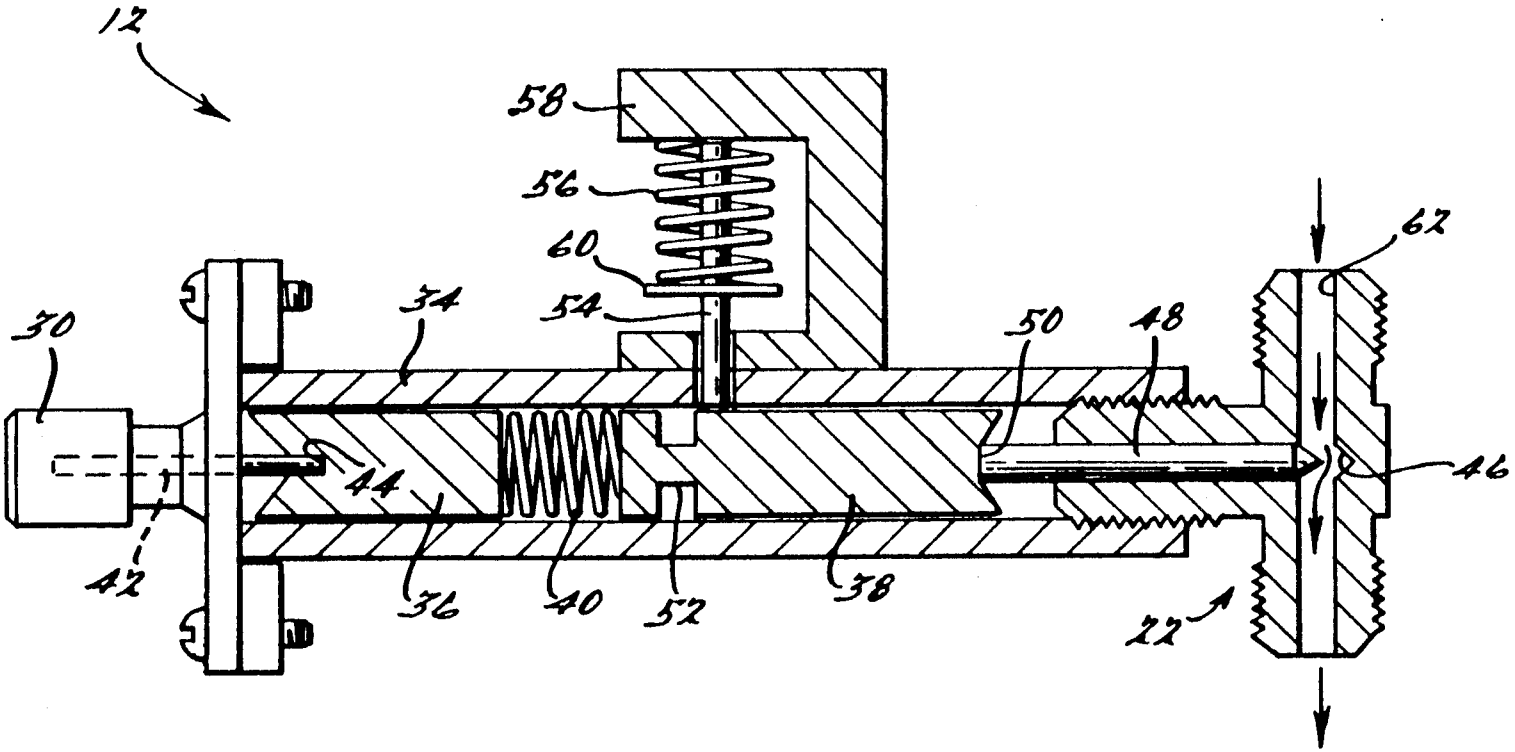
FIG. 2 is a longitudinal cross-sectional view of the fuel flow cut-off means of the preferred embodiment of FIG. 1.

As best shown in FIG. 2, fuel flow cut-off means 12 has a thermostat 30 operatively connected to valve 22. Thus, thermostat 30 is disposed on one end of tubular sleeve 34 and positioned where excessive heat is to be sensed. Pistons 36 and 38 are slidingly carried within sleeve 34 and are mechanically associated with each other by spring 40. Thermostat 30 has pin 42 contacting end 44 of piston 36. Valve 22 comprises valve seat 46 and rod 48 one end of which is in contact with face 50 of piston 38. Piston 38 has annular groove 52 which is adapted to cooperate with latch pin 54 which is urged radially inwardly against piston 38 by spring 56 held in compression between latch frame 58 and washer 60 fixedly secured about latch pin 54. When rod 48 is in a retracted position, fuel flows through conduit 62 of valve 22 and then through fuel line 18.

Figure 3:
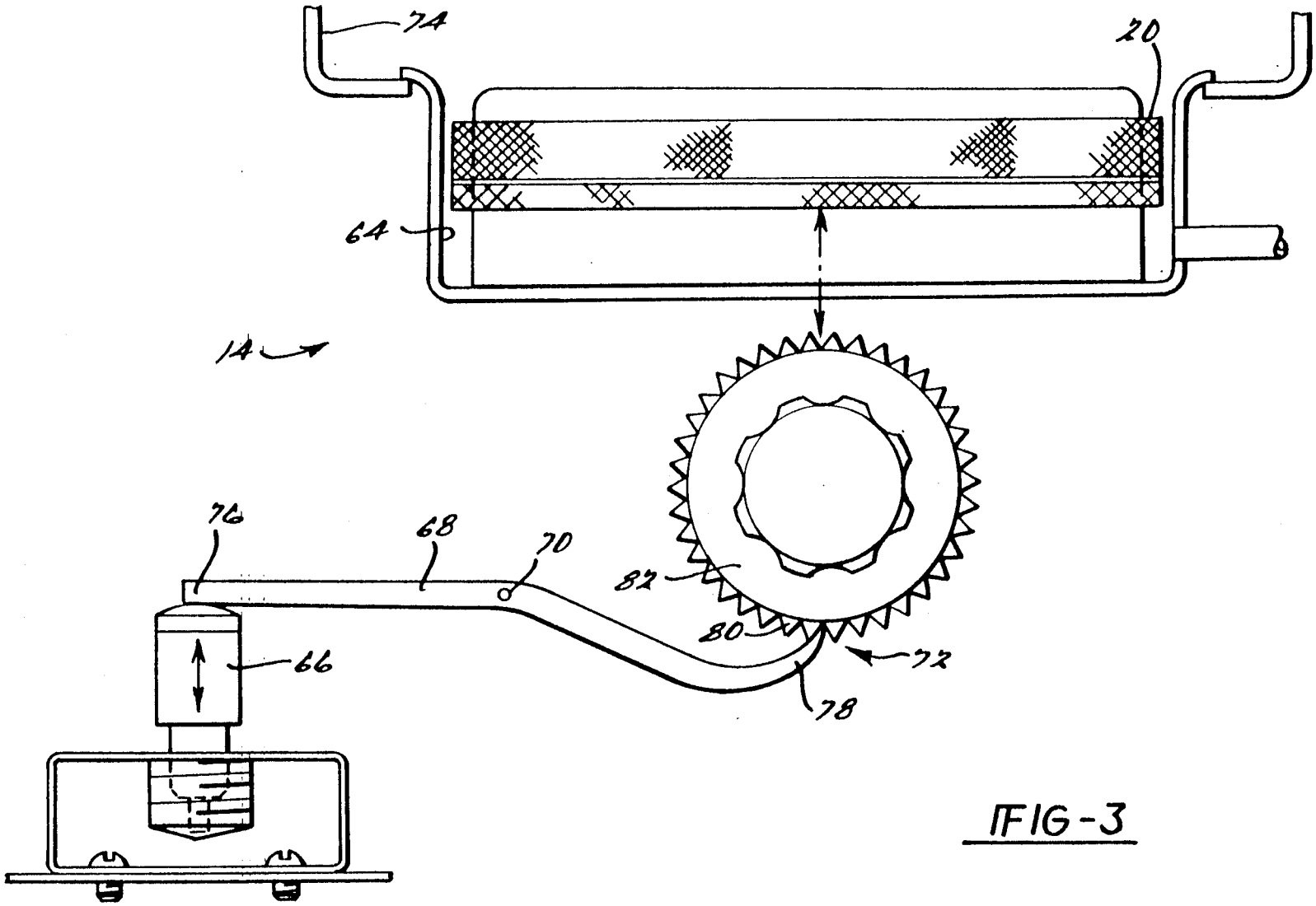
FIG. 3 is an enlarged side elevational view of the wick withdrawing mechanism of the preferred embodiment of FIG. 1.

Wick retracting means 14 is illustrated in detail in FIG. 3. Wick retracting means 14 retracts, i.e. lowers, wick 20 into lower tank 64 to thereby prevent further combustion of fuel on wick 20. Wick retraction means comprises thermostat 66 for sensing excessive heat and which is operatively connected through pivot arm 68 with pivot 70 to spring loaded ratchet mechanism 72 for withdrawing or retracting wick 20 below burner basket 74 and into wick supply reservoir 64.

In operation, when excessive heat occurs, whether caused by the escape of liquid fuel outside of the wick supply reservoir 64 or by any other cause, both fuel shut-off means 12 and wick retracting means 14 operate to extinguish the undesired flames.

Fuel flow cut-off means 12 operates as follows. Excessive flames results in excessive heat which is sensed and which causes a mechanical chain reaction resulting in fuel flow blockage cutting off fuel flow from fuel tank 16 to the flames. Thus, thermostat 30 detects the excessive heat and expands internally causing pin 42 to move, i.e., moves rightwardly as viewed in FIGS. 1 and 2 to thereby move pistons 36 and 38 rightwardly which seats rod 48 against valve seat 46 of valve 22 and shuts off fuel flow through conduit 62. Latch pin 54 engages groove 52 to lock piston 38 in closed position and to thereby maintain valve 22 in a fuel cut-off position.

In operation, wick withdrawal means 14 operates to also prevent undesired flames. Thermostat 66 expands in the presence of excessive heat thereby urging first end 76 of lever 68 upwardly as viewed in FIG. 3. Lever 68 pivots about pivot point 70 lowering second end 78 to move downwardly. Thereby disengaging teeth 80 of ratchet wheel 82 which is spring loaded to rotate and is mechanically linked in a conventional manner to withdraw wick 20. Thus, rotation of ratchet wheel 82 causes wick 20 to drop down into supply reservoir 64. When the wick 20 is contained within supply reservoir 64, an insufficient amount of oxygen is supplied to wick 20 to maintain combustion thereby any flames are extinguished.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. An apparatus for extinguishing undesired flames in liquid fuel-burning heaters having a wick partially disposed in a fuel supply reservoir in fluid communication with a fuel tank said apparatus comprising:

fuel flow cut-off means for interrupting said fluid communication in response to sensing excessive heat; and wick withdrawal means for retracting said wick entirely into said wick fuel supply reservoir in response to sensing of excessive heat.

2. The apparatus according to claim 1, wherein said fuel flow cut-off means has a heat sensing mechanism which in the presence of sufficient heat drives a first pin partially contained within the axial bore of a horizontal sleeve member further into said sleeve member, said first pin in turn driving a first plunger into a first compressible spring which transfers the force upon a second plunger, said second plunger abutting a second pin at a leading edge and having a circumferential groove at the trailing end, said second pin tightly protrudes through the axial bore of a coupled valve member, as said second plunger drives the second pin into the coupled valve member until the leading edge of said second pin tightly fits within a valve seat contained on the interior wall of said coupled valve thereby preventing the flow of fuel.

3. The apparatus according to claim 2, wherein a vertically positioned third pin slides into the circumferential groove contained on said second plunger to lock said second plunger in place thereby securing said second pin in a tightly sealed relationship with said valve seat.

4. A method of limiting the spread of undesired flames in liquid fuel-burning heaters, comprising the steps of:

detecting excessive heat with an expandable heat sensor;

tripping the first end of a pivotal lever with said expanded heat sensor causing a second end of said pivotable lever to disengage a rotatable spring loaded ratchet control gear;

causing the spring of said ratchet control gear to unwind thereby rotating said ratchet control gear effectuating disengagement of a wick; and causing said wick to drop into a wick receiving chamber to suffocate the flame.

5. A method of limiting the spread of undesired flames in liquid fuel-burning heaters, comprising the steps of:

joining an expandable heat sensor to a first pin;

joining said first pin to a first plunger within an elongated sleeve;

abutting a blocking wall portion of said first plunger and a blocking wall portion of a second plunger with a first compressible spring, wherein said second plunger has a circumferential groove near said blocking wall;

joining a second pin to the leading end of said second plunger;

inserting the leading end of said second pin through an axial bore of a valve member coupled to said elongated sleeve;

providing said valve member with a valve seat to tightly entertain the leading end of said second pin;

detecting excessive heat with said heat sensor; and causing expansion of the heat sensor thereby driving the first pin into said first plunger, compressing said first spring thereby transferring forces on said second plunger causing said second plunger to shift forward within said elongated sleeve thereby driving the leading end of said second pin into said valve seat to prevent fluid flow.

6. The method of limiting the spread of undesired flames according to claim 5 wherein said second pin is locked against said valve seat by a third pin which drops into the circumferential groove contained on said second plunger to tightly lock said second pin into said valve seat.

* * * * *